US008960572B2

(12) United States Patent
Pucciani

(10) Patent No.: US 8,960,572 B2
(45) Date of Patent: Feb. 24, 2015

(54) AIR MANIFOLD HAVING NOZZLES

(75) Inventor: Allen S. Pucciani, Beavercreek, OH (US)

(73) Assignee: Illinois Tool Works Inc., Glenview, IL (US)

( * ) Notice: Subject to any disclaimer, the term of this patent is extended or adjusted under 35 U.S.C. 154(b) by 841 days.

(21) Appl. No.: 12/650,373

(22) Filed: Dec. 30, 2009

(65) Prior Publication Data

US 2010/0163653 A1 Jul. 1, 2010

Related U.S. Application Data

(60) Provisional application No. 61/142,132, filed on Dec. 31, 2008.

(51) Int. Cl.

| | |
|---|---|
| ***A62C 31/02*** | (2006.01) |
| ***B05B 1/26*** | (2006.01) |
| ***B21D 53/06*** | (2006.01) |
| ***F26B 21/00*** | (2006.01) |

(52) U.S. Cl.

CPC ..... *B21D 53/06* (2013.01); *F26B 21/004* (2013.01)

USPC ..... 239/557; 239/601; 239/556

(58) Field of Classification Search

USPC ..... 239/557, 601, 566, 548, 565, 556

See application file for complete search history.

(56) References Cited

U.S. PATENT DOCUMENTS

| | | | | | |
|---|---|---|---|---|---|
| 1,396,210 | A | * | 11/1921 | Humphrey | 239/407 |
| 2,166,300 | A | * | 7/1939 | Komar | 29/890.143 |
| 3,503,554 | A | * | 3/1970 | Clifton | 239/23 |
| 3,510,065 | A | * | 5/1970 | Gigantino et al. | 239/590 |
| 3,974,091 | A | * | 8/1976 | Parker et al. | 502/41 |
| 4,322,384 | A | * | 3/1982 | Sutton | 422/144 |
| 5,015,372 | A | * | 5/1991 | Mercer et al. | 239/602 |
| 5,575,423 | A | * | 11/1996 | Yuen | 239/397.5 |
| 5,680,993 | A | * | 10/1997 | McCracken et al. | 239/433 |

* cited by examiner

*Primary Examiner* — Justin Jonaitis

(74) *Attorney, Agent, or Firm* — Fletcher Yoder P.C.

(57) ABSTRACT

An air manifold system that includes an improved air nozzle is provided. In one embodiment, the nozzle has an inlet and an outlet. The inlet of the nozzle may be shaped to conform to the curved outer surface of a main body of the air manifold, and may be welded thereto. The nozzle includes a variable section extending from the nozzle inlet to an intermediate transition point along the length of the nozzle, which has a converging inside diameter, which compensates for flow losses due to cornering. A resistive section extends from the transition point to the outlet, and has a generally constant diameter which is less than the inside diameter of the variable section measured at the nozzle inlet. In one embodiment, the length of the resistive section is less than the length of the variable section.

17 Claims, 5 Drawing Sheets

AIR MANIFOLD HAVING NOZZLES

CROSS REFERENCE TO RELATED APPLICATION

This application claims the benefit of U.S. Provisional Patent Application No. 61/142,132, entitled "Air Manifold Having Nozzles," filed on Dec. 31, 2008, which is herein incorporated by reference in its entirety.

BACKGROUND

The present disclosure relates generally to fluid discharge devices and, more particularly, to air manifolds having one or more nozzles through which a supply of air is distributed.

A variety of systems transfer fluids from a fluid supply source to one or more fluid discharge devices. In some systems, an arrangement of fluid conduits, which may include metal pipes, plastic pipes, and/or hoses, may provide a flow path for routing, channeling, or otherwise delivering a fluid from a fluid supply source to a fluid discharge device, such as an air manifold. In the case of an air manifold, air received via an inlet may be pressurized and directed through a series of nozzles. The output of the nozzles may be utilized for a variety of applications, such as drying and removing moisture from objects, removing dust or debris, cooling, surface preparation, and so forth.

BRIEF DESCRIPTION

Certain aspects of embodiments disclosed herein by way of example are summarized below. It should be understood that these aspects are presented merely to provide the reader with a brief summary of certain forms an invention disclosed and/or claimed herein might take, and that these aspects are not intended to limit the scope of any invention disclosed and/or claimed herein. Indeed, any invention disclosed and/or claimed herein may encompass a variety of aspects that may not be set forth below.

Embodiments of an air manifold system that includes improved air nozzles are provided. In one embodiment, a system includes an air manifold that has a first nozzle having an inlet and an outlet. The nozzle may be joined to an opening on the main body by welding. The inlet of the nozzle may be shaped to conform to the outer surface of the main body. The nozzle includes a variable section and a resistive section. The variable section extends from the nozzle inlet to an intermediate transition point along the length of the nozzle, and has a converging inside diameter, which allows for an air flow entering the nozzle from the main body to compensate for flow losses due to cornering as the air flow enters the nozzle inlet. The resistive section extends from the transition point to the nozzle outlet, and has a generally constant diameter which is less than the inside diameter of the variable section when measured at the nozzle inlet. The resistive section thus resists and controls the flow of the air being discharged from the nozzle outlet. In accordance with aspects of the disclosure, the length of the resistive section is less than the length of the variable section.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
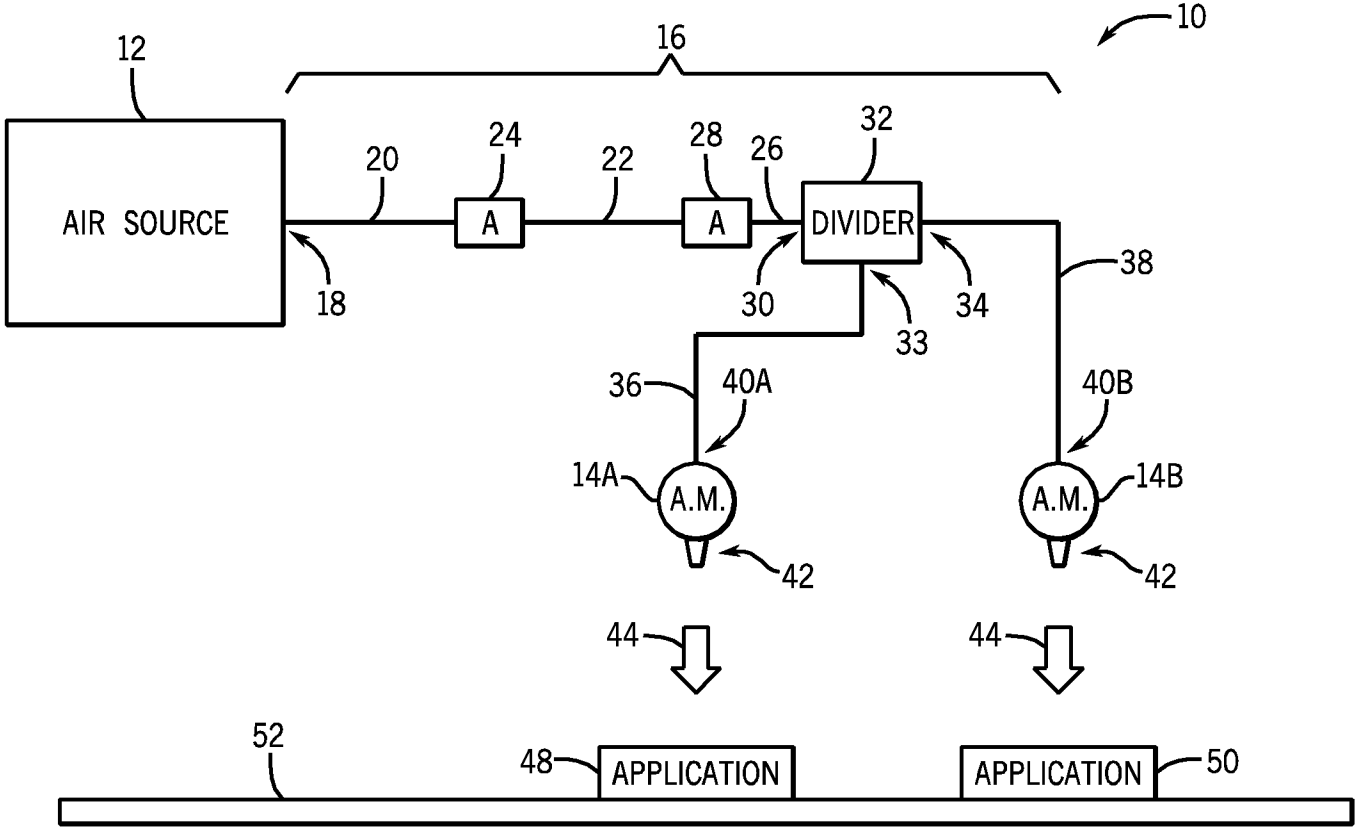
FIG. 1 is a simplified block diagram depicting a fluid-based system that includes one or more air manifolds having nozzles, in accordance with embodiments of the present disclosure.

One or more specific embodiments will be described below. These described embodiments are provided only by way of example, and do not limit the scope of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments described below, the articles "a," "an," and "the" are intended to mean that there are one or more of the elements. The terms "comprising," "including," and "having" are intended to be inclusive and mean that there may be additional elements other than the listed elements. Moreover, while the term "exemplary" may be used herein in connection to certain examples of aspects or embodiments of the presently disclosed subject matter, it will be appreciated that these examples are illustrative in nature and that the term "exemplary" is not used herein to denote any preference or requirement with respect to a disclosed aspect or embodiment. Additionally, it should be understood that references to "one embodiment," "an embodiment," "some embodiments," and the like are not intended to be interpreted as excluding the existence of additional embodiments that also incorporate the disclosed features.

As discussed in further detail below, various embodiments of an air manifold system that includes improved air nozzles are provided. In one embodiment, a system includes an air manifold that a first nozzle having an inlet and an outlet. The nozzle may be joined to an opening on the main body by welding. The inlet of the nozzle may be shaped to conform to the outer surface of the main body. This reduces the need for additional fasteners and thus reduces manufacturing and/or assembly time and costs.

The nozzle includes a variable section and a resistive section. The variable section extends from the nozzle inlet to an intermediate transition point along the length of the nozzle, and has a converging inside diameter, which allows for an air flow entering the nozzle from the main body to compensate for flow losses due to cornering as the air flow enters the nozzle inlet. The resistive section extends from the transition point to the nozzle outlet and has a generally constant diameter which is less than the inside diameter of the variable section measured at the nozzle inlet. The resistive section thus resists and controls the flow of the air being discharged from the nozzle outlet. In accordance with aspects of the disclosure, the length of the resistive section is less than the length of the variable section. The foregoing design, which is discussed in detail below, compensates for air flow losses due to cornering, and thereby improves overall air flow through the body of the nozzle.

Turning now to the drawings, FIG. 1 illustrates a processing system 10 that may incorporate one or more aspects of the presently disclosed techniques. The processing system 10 includes an air supply source 12 that may deliver a fluid (e.g., air) to air manifolds 14A and 14B along a flow path 16. In the illustrated embodiment, the flow path 16 includes the fluid conduits 20, 22, 26, 36, and 38, the adapters 24 and 28, and the divider 32.

In the presently illustrated system 10, the air supply source 12 may include a high flow centrifugal blower ("air blower") which, in some embodiments, may include a supercharger and motor configuration. In one embodiment, the operating characteristics of the air blower 12 may provide an air flow having a pressure of between approximately 1-10 pounds per square inch (psi) and having a flow rate of between approximately 50-2000 cubic feet per minute (CFM) or more specifically, between approximately 150 to 1500 CFM. In some embodiments, the air blower 12 may be housed within an enclosure. The air blower 12 may be separated from the air manifolds 14A and 14B by a distance of 10, 20, 30, 40, 50, 100, or 200 feet or more. As such, the flow path 16 is configured to provide a path through which air provided by the air blower 12 may be routed and ultimately delivered to the air manifolds 14A and 14B.

The air blower 12 may include an outlet 18 coupled to the fluid conduit 20 that defines a first portion of the flow path 16. The fluid conduit 20 may be coupled to the downstream fluid conduit 22 by way of a first adapter 24. By way of example only, the fluid conduit 20 may be a hose, such as a flexible hose, and the fluid conduit 22 may be a pipe, such as a stainless steel pipe or a polyvinyl chloride (PVC) pipe. The adapter 24 may be configured to provide an interface for coupling the hose 20 and pipe 22. For instance, the adapter 24 may include a first adapter end configured to couple to the hose 18, and a second adapter end configured to couple to the pipe 20. In this manner, the hose 20, adapter 24, and pipe 22 are fluidly coupled, thereby allowing air discharged from the outlet 18 of the blower 12 to flow from the hose 20 into the pipe 22.

The flow path 16 continues to the distal end of the pipe 22, which may be coupled to another hose 26 by way of a second adapter 28 that may be similar in design to the first adapter 24. Thus, by way of the adapters 24 and 28, the air flow from the blower 12 may be received by an inlet 30 of a flow divider 32. The flow divider 32 may be configured to distribute or split the air flow to multiple outlets 33 and 34. Additional fluid conduits 36 and 38 may respectively couple the outlets 33 and 34 to the air manifolds 14A and 14B, respectively. In the illustrated embodiment, the air manifolds 14A and 14B may each include an inlet (40A and 40B) configured for a hose connection, and the fluid conduits 36 and 38 may thus be provided as hoses, such as flexible hoses. In other embodiments, a pipe may be disposed between the divider 32 and one of the air manifolds 14A or 14B, whereby adapters similar to the above-discussed adapters 24 or 28 are coupled to each end of the pipe to facilitate a fluid connection between hoses extending from an outlet (e.g., 33 or 34) of the divider 32 and from an inlet (e.g., 40A or 40B) of one of the air manifolds (e.g., 14A or 14B). In some embodiments, the system 10 may include only a single air manifold (e.g., 14A) and thus may not include a divider 32. In such embodiments, the fluid conduit 26 may be coupled directly to the air manifold 14A.

As will be discussed further below, the air manifold 14A may include a main body or housing that defines a plenum or fluid cavity for receiving an air flow via the inlet 40A. In certain embodiments, the air manifold 14A may be formed of materials including aluminum, stainless steel, plastic or composite materials, or some combination thereof. In some embodiments, the main body may be generally cylindrical in shape and may include one or more openings which provide a path for air to flow into respective nozzles 42 coupled to the main body of the air manifold.

In operation, the fluid cavity defined by the main body of the air manifold 14A may pressurize and discharge air received via the inlet 40A through the nozzle(s) 42, as indicated by the output air flow 44. Accordingly, the air flow 44 exiting the nozzle(s) 42 may have a velocity that is greater than the velocity of the air flow entering via the inlet 40A. As can be appreciated, the air manifold 14B may be constructed in a manner that is similar to the air manifold 14A and, thus may operate in a similar manner. Further, while only two outlets 33 and 34 are shown in FIG. 1, it should be appreciated that the flow divider 32 may be configured to provide any suitable number of outlets, and may provide flow paths to any suitable number of devices, such as additional air manifolds, air knives, flow dividers, and so forth. As will be discussed further below, the nozzle 42, as designed in accordance with embodiments of the present disclosure, may provide for improved air flow by reducing losses due to cornering as air flows over sharp corners, such as the interface between the main body or housing of the air manifold 14A and the inlet of the nozzle 42.

As shown in FIG. 1, the air flows 44 exiting the respective nozzles 42 of each of the air manifolds 14A and 14B may be directed towards the applications 48 and 50, respectively, of the processing system 10. For instance, the applications 48 and 50 may be transported through the system 10 along a conveyor belt 52 or some other suitable type of transport mechanism. As will be appreciated, the application represented by the system 10 may utilize the air flows 44 provided by the air manifolds 14A and 14B, respectively, for a variety of functions, including but not limited to drying products, removing dust or debris, coating control, cooling, leak detection, surface impregnation, corrosion prevention, and so forth. For instance, in certain embodiments, the system 10 may be a system for drying food or beverage containers, such as cans or bottles, or may be a system for removing dust and other debris from sensitive electronic products, such as printed circuit boards (PCBs) or the like. In addition, some embodiments of the system 10 may also utilize the air flows 44 to clean and/or remove debris from the conveyer belt 52.

Figure 2:
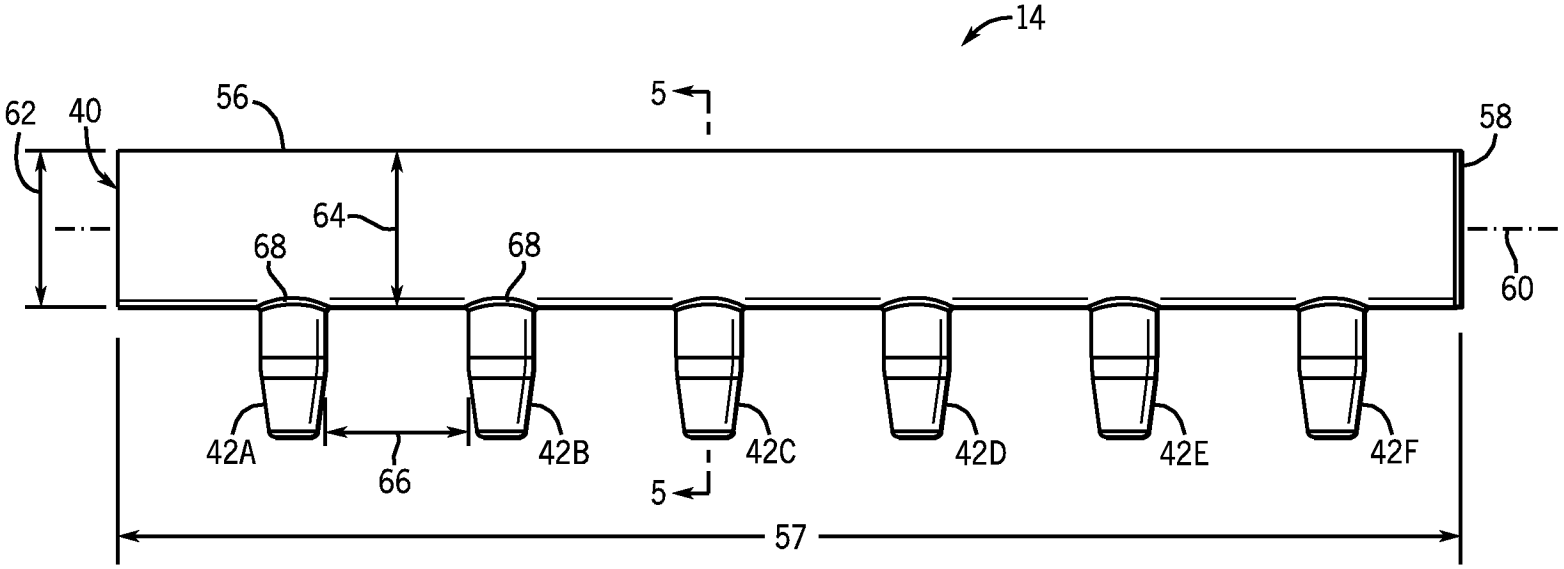
FIG. 2 is a side view of an embodiment of an air manifold with nozzles that may be utilized in the system of FIG. 1.

FIG. 2 is a side view of an embodiment of the air manifold 14, which may be utilized in the system 10 of FIG. 1. As shown in FIG. 2, the air manifold 14 includes a main body or housing 56 which may have an axial length 57 (e.g., measured along the longitudinal axis 60). By way of example only, the length 57 of the main body 56 may be between approximately 0.5 feet to 4 feet (e.g., 0.5, 1, 1.5, 2, 2.5, 3, 3.5, or 4 feet). In other embodiments, the length 57 may also be greater than 4 feet (e.g., 5, 6, 7, or 8 feet).

The main body 56 in the depicted embodiment is generally cylindrical in shape (e.g., having a generally circular cross section). In other embodiments, the main body 56 may have an oval-shaped cross-section, a diamond-shaped cross-section, a triangular-shaped cross section, a square or rectangular-shaped cross-section, and so forth. A first end of the main body 57 is open and forms the inlet 40. As mentioned above, air supplied by the air source 12 may be routed to the air manifold 14 through the inlet 40 and discharged via the nozzles 42A-42F. For instance, the inlet 40 may be coupled to a fluid conduit (e.g., conduit 36). A second end (a sealed end) of the main body 56 that is opposite the inlet end may be sealed by an end cap 58. In certain embodiments, the end cap 58 may have a shape that is generally the same as the cross-sectional shape of the main body 56 (e.g., circular). The end cap 58 may be joined to the main body 56 by welding (e.g., tungsten inert gas (TIG) welding), or fastened to the main body 56 using one or more screws, bolts, or any other suitable type of fastener.

The inlet 40 and the main body 56 are depicted in FIG. 2 as having diameters 62 and 64, respectively. In certain embodiments, the diameters 62 and 64 may be equal. By way of example only, in one embodiment, the diameters 62 and 64 may be between approximately 1 to 6 inches (e.g., 2, 2.5, 3, 3.5, 4, 4.5, 5, 5.5, or 6 inches). In other embodiments, the diameters 62 and 64 may be different sizes. Further, in some embodiments, the diameter 64 may vary along the length 57 of the main body 56. For instance, the diameter may 64 progressively decrease or increase from the inlet end to the sealed end (e.g., having end cap 58).

As shown, the air manifold 14 includes the nozzles 42A-42F extending radially outwards from the main body 56. As will be discussed below with respect to FIG. 3, the main body 56 may include a number of openings, each of which corresponds to a respective one of the nozzles 42A-42F. The inlet ends of the nozzles 42A-42F may be welded to the main body 56 via TIG welding, as mentioned above, or via any other suitable type of welding technique, as shown by the weld joints 68. In particular, the inlet ends of the nozzles 42A-24F may be welded to the openings on the main body 56, such that air flowing into the main body 56 of the air manifold 14 via the inlet 40 may flow through an opening of the main body 56 and into a respective one of the nozzles 42A-42F. That is, each nozzle 42A-42F and its respective opening on the main body 56 may define a flow path by which air within the main body 56 may be discharged from the air manifold 14.

While the depicted embodiment of FIG. 2 shows six nozzles (42A-42F), it should be appreciated that various embodiments may provide any suitable number of nozzles. For instance, certain embodiments may include 2 to 20 nozzles or more. The nozzles 42A-42F may be axially spaced apart along the length 57 of the main body 56, such that each nozzle 42A-42F is separated in the axial direction (e.g., along axis 60) by the distance 66. The distance 66, in some embodiments may be between approximately 1 to 12 inches (e.g., 1, 1.5, 2, 2.5, 3, 3.5, 4, 4.5, 5, 5.5, 6, 7, 8, 9, 10, 11, or 12 inches). In other embodiments, the distance 66 may be determined as a percentage of the total axial length 57 of the body. By way of example, in certain embodiments, the distance 66 may be between approximately 10 to 30 percent or, more specifically, between approximately 15 to 25 percent of the length 57 of the main body 56. In further embodiments, the spacing 66 may be different between each nozzle 42A-42F. For instance, in one embodiment, the spacing 66 may progressively increase or decrease from the inlet end to the sealed end of the air manifold 14.

Figure 3:
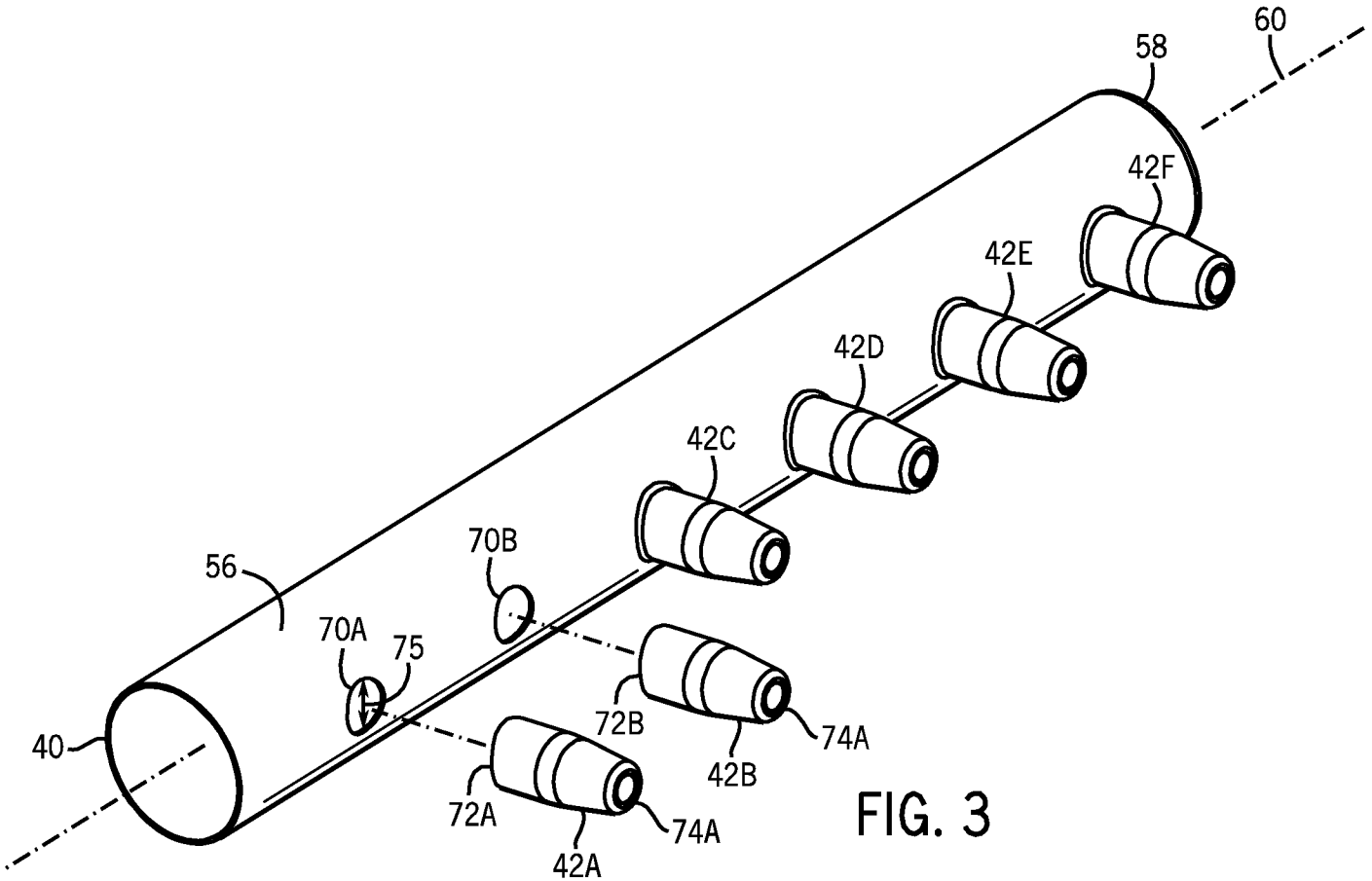
FIG. 3 is a perspective view of the embodiment of the air manifold shown in FIG. 2 depicting two nozzles exploded from a main body of the air manifold.

FIG. 3 shows a perspective view of the air manifold 14 of FIG. 2 rotated approximately 90 degrees about the longitudinal axis 60, and also depicts the nozzles 42A and 42B as being exploded from the main body 56 to better illustrate the above-discussed openings, referred to herein by reference numbers 70A and 70B. As discussed with reference to FIG. 2, each of the nozzles 42A-42F may have an inlet end and an outlet end. For instance, as shown in FIG. 3, the nozzle 42A has an inlet 72A and an outlet 74A, and the nozzle 42B has an inlet 72B and an outlet 74B. As discussed above, the nozzles 42A-42F may be joined to the main body 56 of the air manifold 14 via welding (e.g., TIG welding). For example, the nozzle 42A may be welded to the main body 56, such that the inlet 72A is aligned with (e.g., circumscribes) the opening 70A to define a flow path through which air within the main body 56 may flow into the inlet 72A and be discharged via the outlet 72B. The exploded nozzle 42B may be joined to the main body 56 at the opening 70B in a similar manner. In other words, the openings 70 are formed on the lateral surface(s) of the main body 56, as opposed to a base surface (e.g., the end cap 58). As will be appreciated, when compared to certain air manifolds in which nozzles are press-fitted to a main body, the depicted air manifold 14, which utilizes welding for joining the nozzles 42 to the main body 56, may be more sanitary for food and beverage applications, as weld joints (e.g., 68) generally have fewer crevices in which bacteria may grow or cultivate.

Additionally, it should be appreciated that the remaining nozzles 42C-42F, which are not depicted as being exploded from the main body 56 in FIG. 3, may also be joined to respective openings on the main body 56 of the air manifold. Thus, the reference number 70 shall be understood to generally refer to the openings (which includes 70A and 70B) on the main body 56 to which each of the nozzles 42A-42F (referred to generally by reference number 42) are joined to define respective flow paths by which air may be discharged from the air manifold 14. In the depicted embodiment, the openings 70 may be formed on the main body using any suitable technique, such as drilling, machining, or cutting.

In one embodiment, the openings 70 may axially spaced apart along the length 57 of the main body 56, but may be located at generally the same circumferential position. This results in the nozzles 42, which are joined to the main body 56 at the locations of the openings 70, having generally the same circumferential position with respect to one another, as shown in FIG. 3. In other embodiments, the openings 70 may be arranged at different circumferential positions. The diameter 75 of the openings 70 may be approximately equal to the inside diameter (ID) of the nozzle 42 at the inlet end 72. In some embodiments, the ID of the nozzle 42 and the diameter 75 of the openings 70 may be between approximately 0.5 to 2.5 inches or, more specifically, between approximately 1 to 1.5 inches. Further, some embodiments of the air manifold 14 may include openings 70 of different sizes and, consequently, nozzles 42 having different ID dimensions at their respective inlets 72. The construction of the nozzle 42 will be described further below with respect to FIGS. 5-7.

Figure 4:
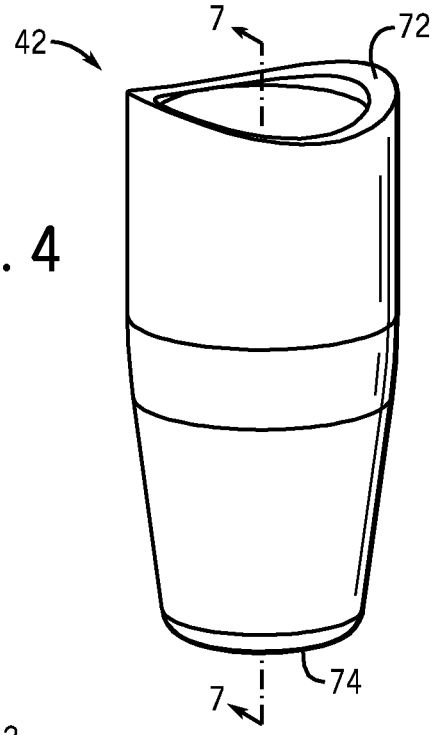
FIG. 4 is a more detailed view of the embodiment of the nozzle shown in FIGS. 2 and 3.

FIG. 4 depicts an enlarged view of an embodiment of the nozzle 42. As shown in the illustrated embodiment, the inlet 72 of the nozzle 42 may be formed or shaped to include a radius, such that the inlet 72 conforms to the outer surface of the generally cylindrical main body 56 to which the nozzle 42 is joined. That is, the shape of the inlet 72 conforms or fits flush against a curved (e.g., curvilinear) outer surface of the main body 56. As will be appreciated, this improves the ease of welding the nozzle 42 to the main body 56 of the air manifold 14, and thereby reduces manufacturing time and costs. In other embodiments, the nozzle 42 may be joined to a main body having an opening formed on a flat surface and, therefore, may not include the radius cut on the inlet 72.

Figure 6:
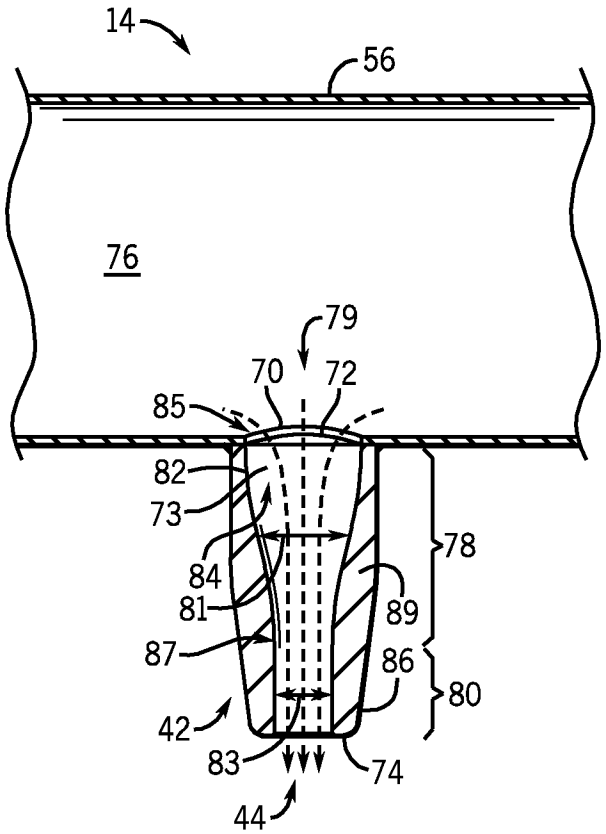
FIG. 6 is a cross-sectional view of the air manifold taken along cut-line 6-6 of FIG. 5, showing the flow of air through one of the nozzles.
Figure 5:
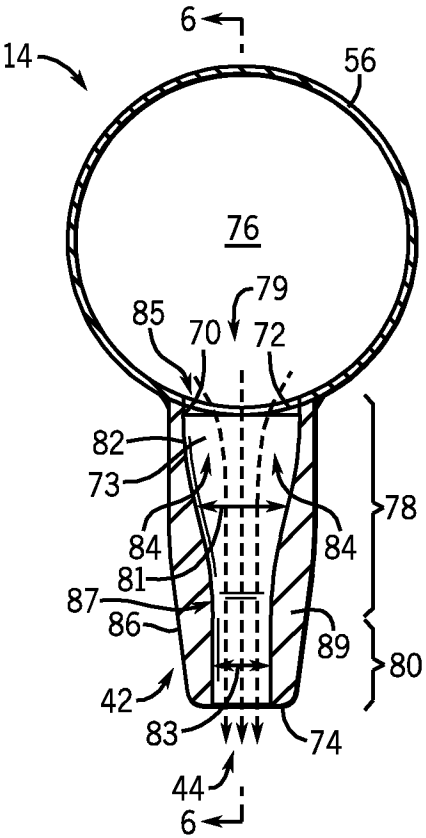
FIG. 5 is a cross-sectional view of the air manifold taken along cut-line 5-5 of FIG. 2, showing the flow of air through one of the nozzles.

FIGS. 5 and 6 show cross-sectional views of the air manifold 14 taken along cut-line 5-5 of FIG. 2 and the cut-line 6-6 of FIG. 5, respectively. FIGS. 5 and 6 will generally be discussed together below. Particularly, FIGS. 5 and 6 depict the flow of air 79 from the main body 56 through a nozzle 42. In the depicted cross-sectional views, the inlet 72 of the nozzle 42 is joined to the opening 70 to define a path by which air 79 flowing into a cavity 76 (via inlet 40) defined by the main body 56 is discharged from the air manifold 14 through the outlet 74 of the nozzle 42 as the output air flow 44 (FIG. 1). That is, the nozzle 42 includes a main body 89 having a passage 73 extending therethrough, which is generally cylindrical in shape, but with a width or diameter that varies in accordance with the changes in the inside diameter of an inside wall 82, as will be discussed further below.

As will be appreciated, air flow naturally forms a radius or void when flowing around sharp corners. This effect, which may be referred to as cornering, may result in losses in pressure and/or throughput as the air flows through certain nozzles. To compensate for such cornering effects, the depicted nozzle 42 may include a first section 78 and a second section 80. The first section 78, which may be referred to as a variable section, has a variable or changing inside diameter (ID), represented by reference number 81. That is, the portion of the inside wall 82 that is part of the variable section 78 may converge, such that the ID 81 decreases as the inside wall 82 transitions away from the inlet 72. The second section 80, which may be referred to as a resistive section, has a generally constant ID, represented here by reference number 83, which is generally less than the ID 81 at the inlet 72 of the nozzle 42. Thus, in the depicted embodiment, the inside wall 82 may gradually converge, such that the ID 81 gradually decreases beginning from the inlet 72 along the length of the variable section 78 (e.g., moving towards the outlet 74). At the point along the inside wall 82 where the ID 81 is approximately equal to the ID 83, referred to here by reference number 87 (e.g., a transition point), the resistive section 80 begins and extends for the remainder of the length of the nozzle 42, terminating at the nozzle outlet 74. The dimensions of the nozzle 42 will be discussed below in more detail with respect to FIG. 7. As will also be discussed below, the section 80 is referred to as a resistive section because it is configured to control or restrict the air flow 79 after cornering effects have been overcome or mitigated in the variable section 78.

By providing an entrance (e.g., inlet 72) having an ID that is greater in diameter than the outlet ID (e.g., 83), the air flow 79 may stabilize prior to reaching the resistive section 80. For instance, as shown in FIGS. 5 and 6, the air flow 79 entering the nozzle 42 flows over corners 85 formed at the interface between the opening 70 and the inlet 72. However, due to cornering, the air flow 79 initially does not flow directly along or against (e.g., in contact with) the inside wall 82 of the nozzle upon entering from the inlet 72, as indicated by the annular space 84. That is, the space 84 is considered to be annular due to the effects of cornering, such that the air flow 79 generally does not initially enter or flow through the annular space 84. As the air flow 79 continues downstream towards the outlet 74, the annular space 84 gradually decreases due to the convergence of the inside wall 82 in the variable section 78 of the nozzle 42. This allows for the air flow 79 to overcome cornering effects that occur during the initial transition from the cavity 76 into the inlet 72 of the nozzle 42.

Because the nozzle 42 includes the variable section 78 that compensates for the effects of cornering, control of the output air flow 44 is provided by the resistive section 80. That is, as the air flow 79 reaches the transition point 87 between the variable section 78 and the resistive section 80, the annular space 84 is substantially reduces or, in some instances, terminated, such that the output air flow 44 is controlled or constricted by the ID 83 of the resistive section 80 and thus by the outlet 74 of the nozzle, as opposed to being limited due to cornering at the inlet 72.

Figure 7:
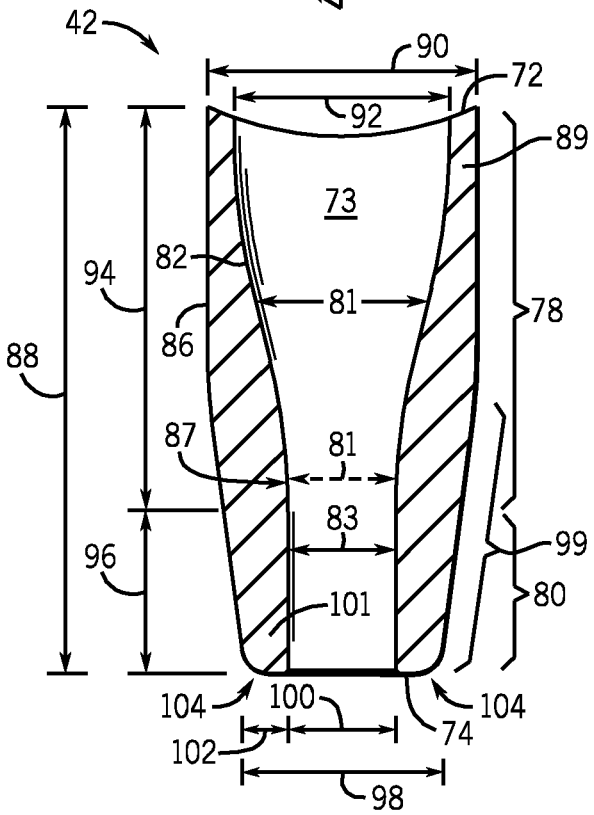
FIG. 7 is an enlarged cross-sectional view of an embodiment of the nozzle taken along cut-line 7-7 of FIG. 4.

FIG. 7 depicts a cross-sectional view of an embodiment of the nozzle 42 taken along the cut-line 7-7 of FIG. 4 and illustrates the dimensions of the nozzle 42 in more detail. As shown, the nozzle may have an overall length 88. The inlet 72 of the nozzle may have an outer diameter (OD) 90 and an inside diameter (ID) 92. Thus, the variable ID 81 of the variable section 78 is equal to the inlet ID 92 when measured at the inlet 72. In certain embodiments, the ID 92 may be approximately equal to the diameter 75 of a corresponding opening 70 (FIG. 3) on the main body 56 of the air manifold 14. By way of example, in certain embodiments, the inlet ID 92 and the diameter 75 of the opening 70 may both be between approximately 0.5 to 2.5 inches (e.g., 0.5, 0.75, 1, 1.25, 1.5, 1.75, 2 or 2.5 inches). The inlet OD 90 may be sized such that it is between approximately 20 to 50 percent greater than the inlet ID 92. For instance, in an embodiment where the inlet ID 92 and the opening 70 are each approximately 1 inch, the inlet OD 90 may be between approximately 1.2 to 1.5 inches.

As the ID 81 of the variable section 78 transitions from the inlet 72 to the transition point 87 (e.g., where the resistive section 80 begins), the ID 81 may decrease by between approximately 40 to 60 percent or, in some embodiments, between approximately 45 to 55 percent relative to the inlet ID 92. The ID 83 of the resistive section 80 may thus be approximately equal to the ID 81 of the variable section 78 when measured at the transition point 87. Accordingly, the ID 83 of the resistive section 80 may be between approximately 40 to 60 percent or, in some embodiments, between approximately 45 to 55 percent the length of the ID 92. By way of example only, in the above-mentioned embodiment where the ID 92 is approximately 1 inch, the ID 83 of the resistive section 80 may be between approximately 0.4 to 0.6 inches or, more specifically, between approximately 0.45 to 0.55 inches, or even more specifically, approximately 0.5 inches. In embodiments, the relationship between the inlet 72 and the outlet 74 may also be expressed in terms of surface area of their respective openings. For instance, in one embodiment, the area of the outlet opening 74 may be between approximately 15 to 40 percent or, more specifically, between approximately 20 to 35 percent the area of the inlet opening 72.

As further shown, the variable section 78 may have a length 94, and the resistive section 80 may have a length 96. In the depicted embodiment, the length 94 of the variable section 78 is greater than the length 96 of the resistive section 80. In other words, the distance along which the ID 81 converges is greater than the distance along which the ID 83 remains generally constant. By way of example only, the length 96 of the resistive section 80, in one embodiment, may be between approximately 25 to 45 percent (e.g., 25, 30, 35, 40, or 45 percent) or, more specifically, between approximately 30 to 35 percent of the total length 88 of the nozzle 42. Accordingly, the length 94 of the variable section 78 may be expressed as the difference between the total length 88 of the nozzle 42 and the length 96 of the resistive section 80. For instance, based on the percentages provided above, the length 94 of the variable section 78 may be between approximately 75 to 55 percent or, more specifically, between approximately 70 to 65 percent the total length 88 of the nozzle 42. By way of example only, in certain embodiments, the length 88 of the nozzle may be between approximately 2 to 4 inches, and the length 96 of the resistive section 80 may be between approximately 0.625 to 1.8 inches. In one particular embodiment, the nozzle 42 may have an overall length 88 of approximately 2.5 inches with a resistive section 80 having a length 96 of approximately 0.75 inches and a variable section 78 having a length 94 of approximately 1.75 inches.

As discussed above, the resistive section 80 has a generally constant ID 83 along its length 96. Thus, the ID 100 of the outlet 74 is approximately equal to the ID 83 of the resistive section 80. In the depicted embodiment, the outside wall 86 may include a taper 99 extending towards the outlet 74 of the nozzle 42, as shown in FIG. 7. As shown, this may result in the OD 98 at the outlet 74 being less than the OD 90 of the inlet 72. By way of example only, in such an embodiment, the outlet OD 98 may be between approximately 60 to 80 percent (e.g., 60, 65, 70, 75, or 80 percent) of the inlet OD 90. Further, in some embodiments, the nozzle 42 may not include the taper 99, and thus the outlet OD 98 may be approximately equal to the inlet OD 90.

The tip at the outlet 74 of the nozzle may include an annular wall 101 (e.g., material between the inner wall 82 and the outer wall 86). The thickness of the annular wall 101 at the outlet 74 is represented by the reference number 102. In certain embodiments, the thickness 102 may be between approximately 20 to 75 percent or, more specifically, between approximately 20 to 50 percent of the outlet ID 100. By way of example only, in one particular embodiment, the ID 92 may be approximately 1.25 inches, the ID 100 may be approximately 0.5 inches, and the thickness 102 may be between approximately 0.125 to 0.25 inches. The thickness 102, when compared to certain nozzles, allows for the nozzle 42 to be more rugged and durable against impacts that may occur in an industrial setting, such as in the process system 10 of FIG. 1. This may prolong the operational life of the nozzles 42 and thus the air manifold 14. Further, in the depicted embodiment, the outermost edge of the outlet 74 that meets the outside wall 86 may include a chamfer 104. In certain embodiments, the degree of the chamfer 104 may be between approximately 30 to 60 degrees, between approximately 40 to 50 degrees, or between approximately 42 to 48 degrees.

As mentioned above, in certain embodiments, the nozzle 42 may be formed from stainless steel, such as a piece of solid stainless steel bar stock. For instance, the nozzle 42 may be manufactured by machining and/or lathing the stainless steel bar stock. The resulting nozzle 42 may be welded (e.g., by TIG welding) about an opening 70 on the main body 56 of the air manifold 14 to form a flow path through which air may be discharged (e.g., as air output 44). Because the inlet 72 may include a radius cut (e.g., as shown in FIG. 4), the inlet 72 of the nozzle 42 may conform against the outer surface of the main body 56, which simplifies the welding process and thus reduces overall manufacturing time and cost. Further, because the nozzle 42 is welded to the main body 56, the need for additional fasteners and the like is reduced. Additionally, weld joints (e.g., 68 of FIG. 2) generally lack crevices in which bacterial growth may occur, which is ideal and beneficial for food and/or beverage applications.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system comprising:

an air manifold comprising a main body having a curved lateral outer surface that includes a first opening located at a first axial position along a length of the main body; and a first nozzle coupled to the first opening of the curved lateral outer surface and extending radially outwards from the main body, wherein the first nozzle comprises a single piece having a first nozzle body, and the first nozzle body comprises:

a first nozzle inlet;

a first nozzle outlet; and a first annular wall defining a first passage that extends through the first nozzle body and which couples the first nozzle inlet to the first nozzle outlet, wherein the first nozzle inlet has a first axial end surface that is radius cut to conform flush against the curved lateral outer surface about the first opening, and the first passage comprises:

a transition point disposed between the first nozzle inlet and the first nozzle outlet, wherein the transition point is disposed nearer to the first nozzle outlet than to the first nozzle inlet;

a variable section extending from the first nozzle inlet to the transition point, wherein a variable inside diameter of the variable section gradually converges from the first nozzle inlet towards the transition point; and a resistive section extending from the transition point to the first nozzle outlet, wherein a resistive inside diameter of the resistive section is constant from the transition point to the first nozzle outlet, the resistive inside diameter is less than the variable inside diameter when measured at the first nozzle inlet, and the resistive inside diameter is equal to the variable inside diameter when measured at the transition point.

2. The system of claim 1, wherein the main body includes a second opening located at a second axial position along the length of the main body, wherein the system comprises:

a second nozzle coupled to the second opening and extending radially outwards from the main body, wherein the second nozzle comprises a second nozzle body having a second nozzle inlet, a second nozzle outlet, and a second annular wall defining a second passage that extends through the second nozzle body and which couples the second nozzle inlet to the second nozzle outlet, wherein the second nozzle inlet has a second axial end surface that is shaped to conform flush against the curved lateral outer surface.

3. The system of claim 2, wherein the main body comprises a generally cylindrical outer surface.

4. The system of claim 3, wherein the first opening and the second opening are located at the same circumferential positions along the generally cylindrical outer surface.

5. The system of claim 2, wherein a spacing between the first and second axial positions is between approximately 10 to 30 percent of the length of the main body.

6. The system of claim 1, wherein the main body comprises:

an inlet on a first end of the curved lateral outer surface for receiving a flow of fluid; and an end cap coupled to an opposite second end of the curved lateral outer surface to define a fluid cavity for receiving the flow of fluid.

7. The system of claim 1, wherein the first nozzle is coupled to the first opening by a weld joint.

8. The system of claim 1, wherein a total length of the first nozzle body is the sum of a first length of the variable section and a second length of the resistive section, the second length is between 25 to 45 percent of the total length, the variable section is configured to compensate for the effects of cornering of a fluid through the first passage, and the resistive section is configured to control the fluid through the first passage.

9. The system of claim 8, wherein the second length is between approximately 30 to 35 percent of the total length of the first nozzle body.

10. The system of claim 1, wherein a thickness of the first annular wall measured at the first nozzle outlet is between approximately 20 to 50 percent of the resistive inside diameter.

11. The system of claim 1, wherein the first nozzle comprises an outside wall having a chamfer at an edge of the first nozzle outlet, wherein a degree of the chamfer is between approximately 30 to 60 degrees.

12. The system of claim 1, wherein the resistive inside diameter of the resistive section is between approximately 40 to 60 percent of the variable inside diameter of the variable section when measured at the first nozzle inlet.

13. The system of claim 1, wherein a surface area measured at an opening of the first nozzle outlet is between approximately 15 to 40 percent of a surface area measured at an opening of the first nozzle inlet.

14. The system of claim 1, wherein a length of the first nozzle body is between approximately 2 to 4 inches.

15. The system of claim 1, wherein the first nozzle body comprises an outside wall having a taper extending towards the first nozzle outlet, and wherein an outside diameter of the outside wall measured at the first nozzle inlet is greater than the outside diameter of the outside wall measured at the first nozzle outlet.

16. The system of claim 1, wherein the first nozzle body is formed from a material comprising stainless steel.

17. The system of claim 1, wherein the first opening comprises a first inner diameter and the first nozzle inlet comprises a second inner diameter and an outer diameter, wherein the first inner diameter is approximately equal to the second inner diameter and the outer diameter is between approximately 20 to 50 percent greater than the first inner diameter.

* * * * *